US007111693B1

(12) United States Patent
Self et al.

(10) Patent No.: US 7,111,693 B1
(45) Date of Patent: Sep. 26, 2006

(54) SYSTEM AND METHOD FOR LOCATING AND TRACKING A BORING TOOL

(75) Inventors: Kelvin P. Self, Stillwater, OK (US); Gerald A. Stangl, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 159 days.

(21) Appl. No.: 10/724,572

(22) Filed: Nov. 26, 2003

Related U.S. Application Data

(60) Provisional application No. 60/429,097, filed on Nov. 26, 2002.

(51) Int. Cl.
*E21B 47/02* (2006.01)

(52) U.S. Cl. ..... 175/40; 175/45; 175/61

(58) Field of Classification Search ..... 175/40, 175/45, 61
See application file for complete search history.

(56) References Cited

U.S. PATENT DOCUMENTS 5,957,222 A 9/1999 Webb et al. ..... 175/45
6,668,946 B1 12/2003 Rankin et al. ..... 175/62
6,776,246 B1 * 8/2004 Nickel et al. ..... 175/45
6,833,795 B1 * 12/2004 Johnson et al. ..... 340/853.5
2003/0152428 A1 8/2003 Wentworth et al. ..... 405/184.2
2004/0188142 A1 * 9/2004 Self et al. ..... 175/53
2005/0115706 A1 * 6/2005 Cole et al. ..... 166/61

* cited by examiner

*Primary Examiner*—William Neuder
(74) *Attorney, Agent, or Firm*—Tomlinson & O'Connell, P.C.

(57) ABSTRACT

A system for monitoring the position and orientation of a downhole tool assembly having multiple beacons. In a preferred embodiment the first and second beacons are supported by the downhole tool assembly. Both beacons are adapted to transmit signals that are indicative of the orientation and position of the downhole tool assembly. A receiving assembly detects the signals transmitted from the first and second beacons. The receiving assembly transmits the detected signals to a processor that processes the signals to produce a composite of the relative positions and orientations of the receiving assembly and the downhole tool assembly. The composite of the relative positions of the receiving assembly and the downhole tool assembly are communicated to the operator using a display. The orientations of the first and second beacons are also communicated to the operator using the display.

40 Claims, 10 Drawing Sheets

SYSTEM AND METHOD FOR LOCATING AND TRACKING A BORING TOOL

CROSS REFERENCE TO RELATED APPLICATIONS

This application claims priority of U.S. Provisional Patent Application Ser. No. 60/429,097 filed Nov. 26, 2002.

FIELD OF THE INVENTION

The present invention relates to an apparatus and method for drilling close tolerance horizontal underground boreholes, in particular horizontal underground boreholes requiring a close tolerance on-grade sloped or horizontal segment—such as for installation of gravity-flow storm drainage and wastewater sewer pipes. More specifically, the present invention enhances directional control during creation of the borehole.

SUMMARY OF THE INVENTION

The present invention is directed to a system for use with a horizontal directional drilling machine to monitor the position and orientation of a downhole tool assembly. The system comprises a first beacon, a second beacon, and a receiving assembly. The first beacon is supported by the downhole tool assembly and has at least one orientation sensor. The first beacon is adapted to transmit signals indicative of the position and orientation of the downhole tool assembly. The second beacon is supported by the downhole tool assembly and spatially separated from the first beacon, wherein the second beacon has at least one orientation sensor and is adapted to transmit signals indicative of the position and orientation of the downhole tool assembly. The receiving assembly comprises an antenna arrangement adapted to detect signals emanating from the first beacon and the second beacon, a processor supported by the receiving assembly, and a display adapted to visually communicate to composite of the relative positions of the receiving assembly and the downhole tool assembly and the orientation of the first beacon and of the second beacon. The processor is adapted to receive the detected signals, to process the detected signals, to generate a composite of the relative positions of the receiving assembly and the downhole tool assembly.

In another aspect the present invention is directed to a horizontal directional drilling system comprising a frame, a drill string having a first end and a second end, a rotary drive system attachable to the frame and operatively connectable to the first end of the drill string, a downhole tool assembly, and a receiving assembly. The drive system is adapted to rotate and advance the drill string. The downhole tool assembly comprises a bearing housing assembly connectable to the second end of the drill string, a first beacon supported by the bearing housing assembly for movement therewith and adapted to transmit signals indicative of the orientation of the bearing housing assembly, a front housing connectable to the bearing housing assembly and rotatable independently of the bearing housing assembly, and a second beacon assembly supported by the front housing for movement therewith and adapted to transmit signals indicative of the orientation of the front housing. The receiving assembly is adapted to monitor the orientation of the bearing housing assembly and the front housing and comprises an antenna assembly adapted to detect the signals emanating from both the first beacon and the second beacon and to transmit the detected signals, and a processor assembly adapted to receive the detected signals from the antenna assembly, to process the detected signals to determine the orientation of the front housing and the orientation of the bearing housing assembly.

In yet another aspect the present invention comprises a downhole tool assembly for use with a rotatable drill string. The assembly comprises a rotatable bearing housing assembly connectable to a second end of the rotatable drill string, a first beacon supported by the bearing housing assembly for movement therewith and adapted to transmit signals indicative of the orientation of the bearing housing assembly, a front housing connectable to the bearing housing assembly and rotatable independently of the bearing housing assembly, and a second beacon assembly supported by the front housing for movement therewith and adapted to transmit signals indicative of the orientation of the front housing.

In a further embodiment, the present invention comprises a method for drilling a borehole using a downhole tool assembly and a receiving assembly. The downhole tool assembly comprises a first beacon and a second beacon both supported by the downhole tool assembly, wherein the first beacon is adapted to transmit a first locating signal and wherein the second beacon is adapted to transmit a second locating signal. The method comprises sensing the first locating signal emanating from the first beacon and the second locating signal emanating from the second beacon, and processing the sensed first and second locating signals to generate a composite of the relative position of the receiving assembly to the first beacon and the second beacon.

In still another embodiment, the present invention comprises a method for drilling a borehole having a desired pitch using a downhole tool assembly and a signal receiving assembly. The downhole tool assembly comprises a first beacon adapted to emit a first pitch signal indicative of the pitch orientation of the first beacon and a second beacon spatially separated from the first beacon and adapted to emit a second pitch signal indicative of the pitch orientation of the second beacon. The method comprises sensing the first pitch signal and the second pitch signal using the signal receiving assembly, processing the first pitch signal and the second pitch signal substantially simultaneously to determine the pitch orientation of the first beacon and the pitch orientation of the second beacon, and comparing the pitch of the first beacon and the pitch of the second beacon to the desired pitch.

BRIEF DESCRIPTION OF THE DRAWINGS

FIG. 1 illustrates a drilling machine acting on an uphole end of either a single-member or a dual-member drill string and the drill string supports a downhole tool assembly.

FIG. 5 illustrates the use of the downhole drilling assembly with a dual-member drill string.

FIG. 10 illustrates a sensor assembly having two sets of three mutually orthogonal antennas supported by a hand-held frame.

FIG. 11 is a diagrammatic representation of a display used to visually communicate a composite of the operating area. The display composite shows the position of the downhole drilling assembly relative to the walkover tracking receiver.

DESCRIPTION

Figure 1:
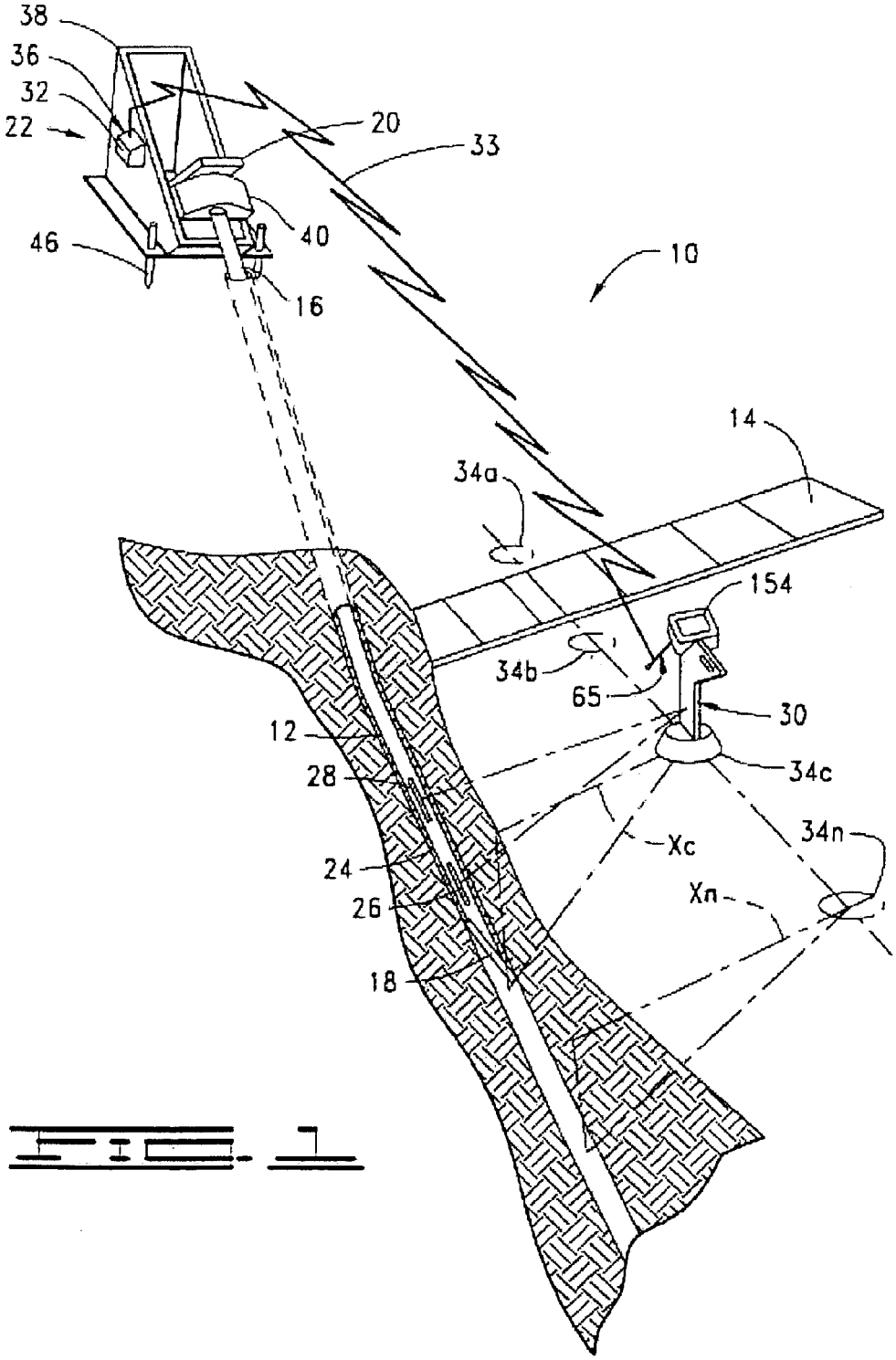
FIG. 1 is a diagrammatic representation of a horizontal directional drilling system constructed in accordance with the present invention.

Turning now to the drawings in general and FIG. 1 in particular, there is shown therein a horizontal directional drilling ("HDD") system 10 constructed in accordance with the present invention. FIG. 1 illustrates the usefulness of horizontal directional drilling by demonstrating that a borehole 12 can be made without disturbing an above-ground structure, namely a roadway as denoted by reference numeral 14. To cut or drill the borehole 12, a drill string 16 carrying a drill bit 18 is rotationally driven by a rotary drive system 20. When the HDD system 10 is used for installation of gravity-flow utilities, for example, close-tolerance or on-grade requirements are imperative. The present invention is directed to a system and method for drilling with close-tolerance and on-grade requirement.

The HDD system 10 of the present invention is suitable for near-horizontal subsurface placement of utility services, for example under the roadway 14, building, river, or other obstacle. The HDD system 10 is particularly suited for drilling close-tolerance boreholes such as may be useful for the installation of on-grade gravity-flow storm drainage and wastewater sewer pipes. Close-tolerance lateral control of the borehole 14, also practical with HDD system 10, is advantageous in numerous applications besides gravity-flow. For instance, close-tolerance lateral control of borehole 14 progress can be advantageous where the available easement corridor for utility service placement is of restricted width, or when other utility services already reside within the corridor. These and other advantages associated with the present invention will become apparent from the following description of the preferred embodiments.

With continued reference to FIG. 1, the HDD system 10 comprises the drilling machine 22 operatively connected by the drill string 16 to a downhole tool assembly 24. The HDD system 10 further comprises the drill bit 18 or other directional boring tool, the downhole transmitters or beacons 26 and 28, and the tracking receiver 30. The progression of the borehole 12 along a desired path is facilitated by communication of information 33 between the tracking receiver 30 and controls 32 for the HDD system 10.

In operation, receiver 30 may be positioned at one of a series of reference placement stations 34*a* through 34*n* on the ground surface in approximate parallel alignment with the intended path of borehole 12. Generally, receiver 30 is offset to one or the other side by the respective distances Xa through Xn. In FIG. 1, the receiver 30 is shown positioned at point 34*c* and offset a distance Xc from the intended borehole 12. These distances may be substantially similar, for instance within 5–10% of each other, though not required. Operation of the receiver 30 in conjunction with beacons 26 and 28, as yet to be described, permits creation of a close-tolerance, on-grade borehole 12.

The operation of HDD system 10 and the drilling machine 22 may be controlled manually through a system of levers, switches or similar controls at a control station 36. Alternatively, operational control may be through a system that automatically operates and coordinates the various functions comprising the drilling operation. Such an automated control system is (not shown) disclosed in commonly assigned U.S. patent application Ser. No. 09/481,351, the contents of which are incorporated herein by reference. As used herein, automatic operations are intended to refer to operations that can be accomplished without operator intervention and within certain predetermined tolerances.

Referring still to FIG. 1, the drilling machine 22 comprises a frame 38, a carriage 40 movably supported on the frame, a spindle 42 (shown in FIG. 3) rotatably supported by the carriage, and a rotary drive system 20 operatively connected to the spindle. In the preferred embodiment, the drill string 16 is connected to the spindle 42 by way of a threaded connection, though other ways of connecting the drill string to the drilling machine 22 may be used. Advancement of the carriage 40 by way of an axial advancement means (not shown), and operation of the rotary drive system 20 provide for advancement and rotation of the spindle 42 and, in turn, the drill string 16 and the directional boring tool 18 to create the borehole 12. Reactionary forces on the drilling machine 22 may be resisted by machine weight supplemented by earth anchors 46. As may be necessary at times, the directional boring tool 18 is disengaged from the earth at the distant end of borehole 12 by retraction of drill string 16 through reverse movement (to that described above) of the carriage 40 and rotary drive system 20.

Use of the drilling machine 22 in a traditional manner permits the directional boring tool 18 to be steered or guided along a desired path Generally, the present position and angular orientation of the directional boring tool 18 are determined using a tracking system such as the previously mentioned beacons 26, 28 and walkover receiver 30 in a manner yet to be described. That information may be compared to the pre-planned desired path for the borehole 12 to determine whether a steering correction is necessary. If a steering correction is not needed, the directional boring tool 18 is advanced in a straight line by advancing and rotating the drill string 16. If a steering correction is required, the directional boring tool 18 is rotated to a proper heading (i.e., roll position). Change the direction of the borehole 12. The drill string 16 is then thrust forward by advancing carriage 40 without rotation by the rotary drive 20. The directional boring tool 18 deflects off its previous course heading as the tool engages virgin soil beyond the point where rotational advance ceased. Steering response can be diminished—as may be necessary for example while drilling a curved section of the planned borepath—by periodically interjecting short "straight" (advance with rotation) drilling segments.

As used herein, directional boring tool 18 may be any drilling device or drill bit which may cause deviation of the tool from a straight path when thrust forward without rotation, or if thrust forward while being repetitively rocked through an arc of partial rotation as disclosed in U.S. Pat. No. 6,109,371 issued to Kinnan, incorporated herein by reference or by other know methods. Directional boring tools suitable for use with the present invention include those described in U.S. Pat. No. 5,799,740, issued to Stephenson, et al., the contents of which are incorporated herein by reference, as well as carbide studded cobble drilling bits and replaceable tooth rock drilling bits.

The horizontal directional drilling system 10 depicted in FIG. 1 and of the present invention may be used with either a dual-member or a single-member drill string Specifically, in accordance with a first downhole tool assembly 48 embodiment of the present invention (shown in FIG. 4 and yet to be described) drill string 16 comprises a dual-member drill string. Alternatively, of downhole tool assembly 50 (shown in FIG. 6 and yet to be described), the drill string 16 comprises a single-member drill string. The drill string 16 may be continuous, or comprise the assembly of a plurality of pipe sections (a.k.a. pipe joints).

Figure 2:
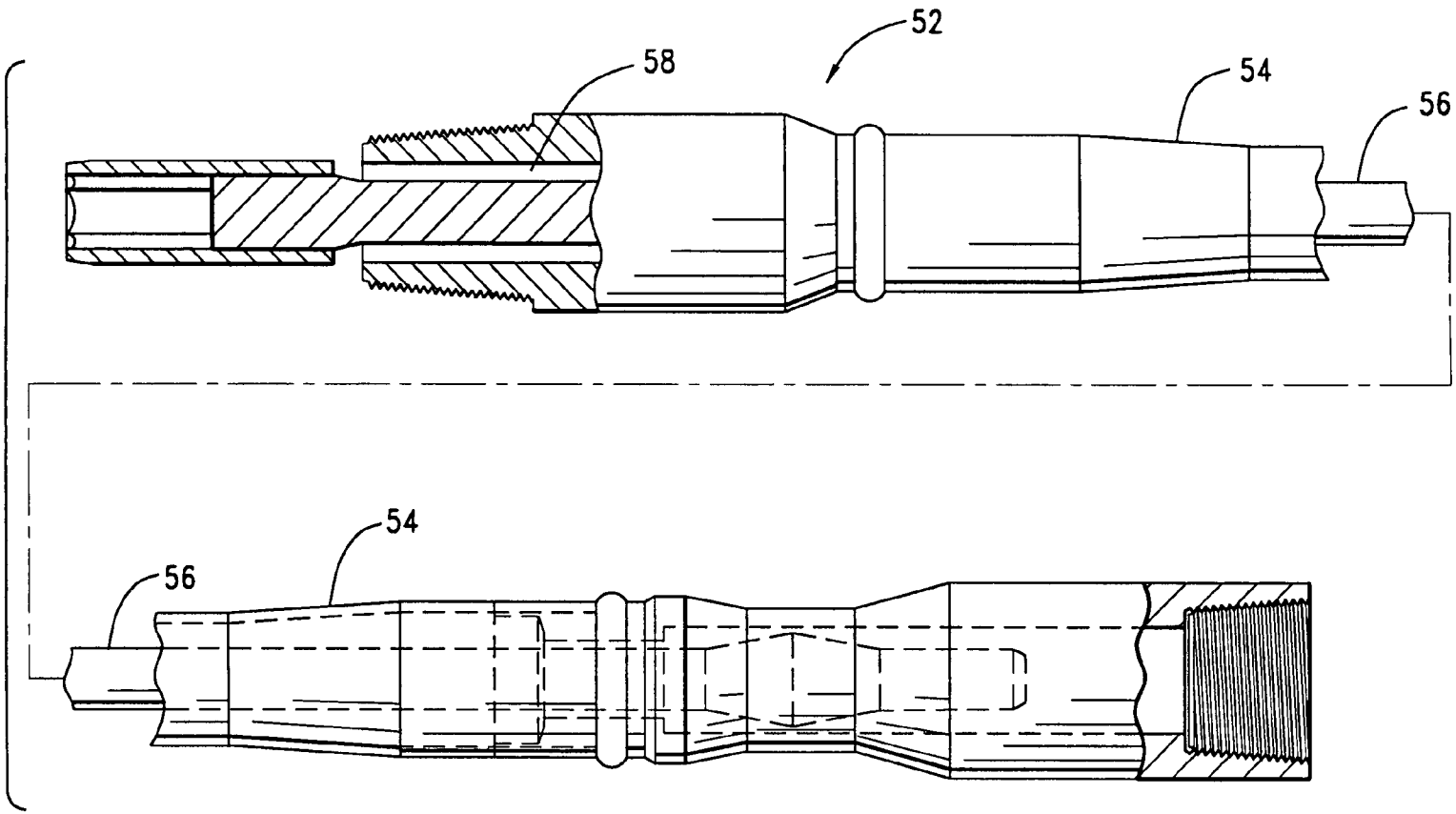
FIG. 2 is a fragmented, side elevational, partly sectional view of a pipe section used with a dual-member drill string.
Figure 4:
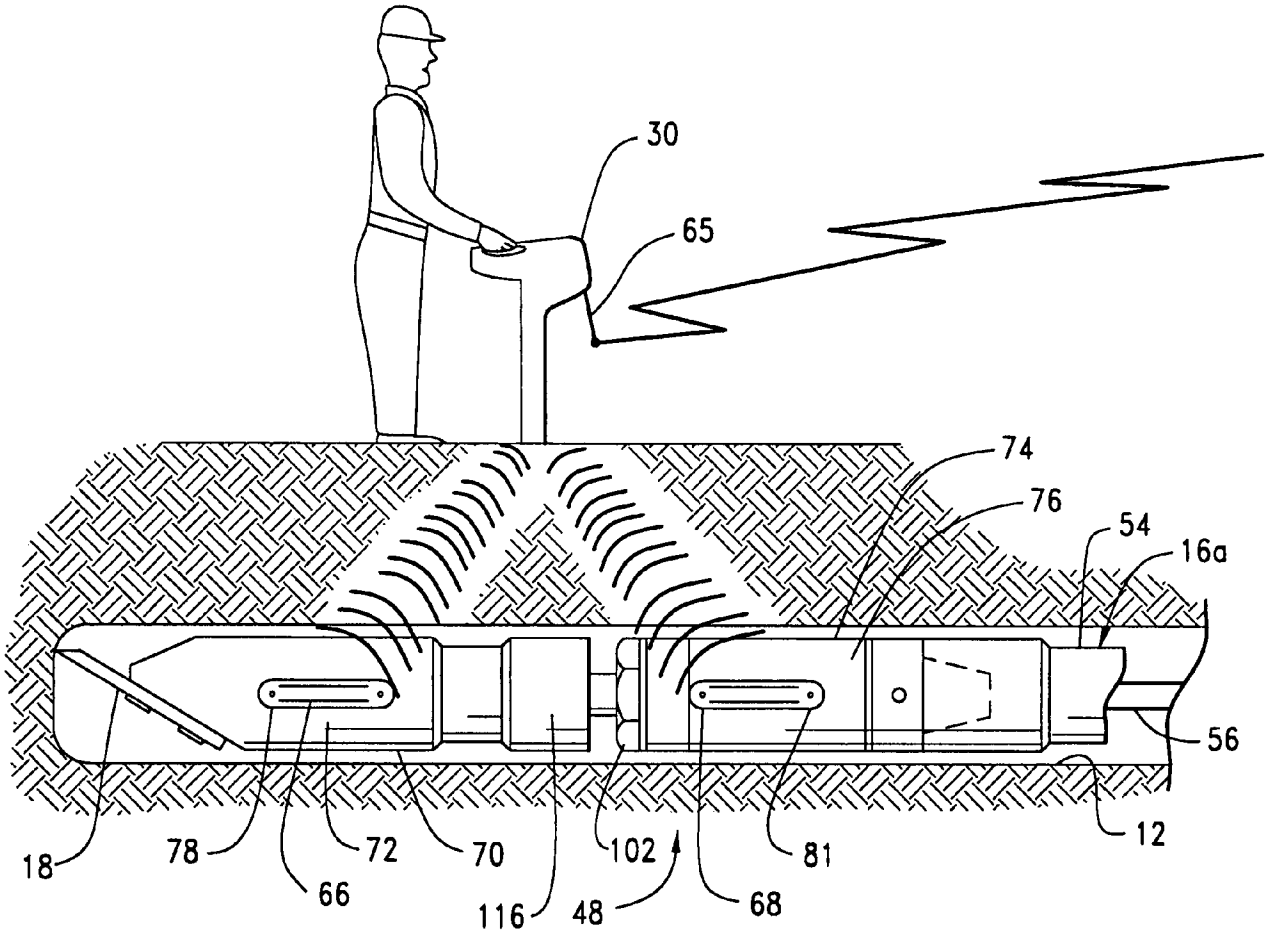
FIG. 4 is a diagrammatic side view of a downhole drilling assembly disposed within the borehole and a walkover tracking receiver.

Turning now to FIG. 2, there is shown one of a plurality of dual-member pipe sections 52 comprising the dual-member drill string 16. The dual-member pipe section 52 comprises an outer member 54 and an inner member 56. Outer members 54 and inner member 56 of adjacent pipe sections, 52 are connected to form the dual-member drill string 16*a* (FIG. 4). Interconnected inner members 56 of adjacent dual-member pipe sections 52 are rotatable independently of the interconnected outer members 54. An annular space 58 between the inner members 56 and outer members 54, or a hollow tubular construction for inner member 56 (not illustrated), may be useful for conveyance of drilling fluid downhole for purposes later described. One or the other of these longitudinal cavities may also be useful for conveyance of slurried drill cuttings uphole for disposal. It will be appreciated that any dual-member drill string having an outer member and an inner member, the inner member disposed within the outer member and independently rotatable, may be used with the present invention. Embodiments for suitable dual member drill strings are described in U.S. Pat. No. 5,490,569 and U.S. Pat. No. 5,682,956, the contents of which are incorporated herein by reference.

Figure 3:
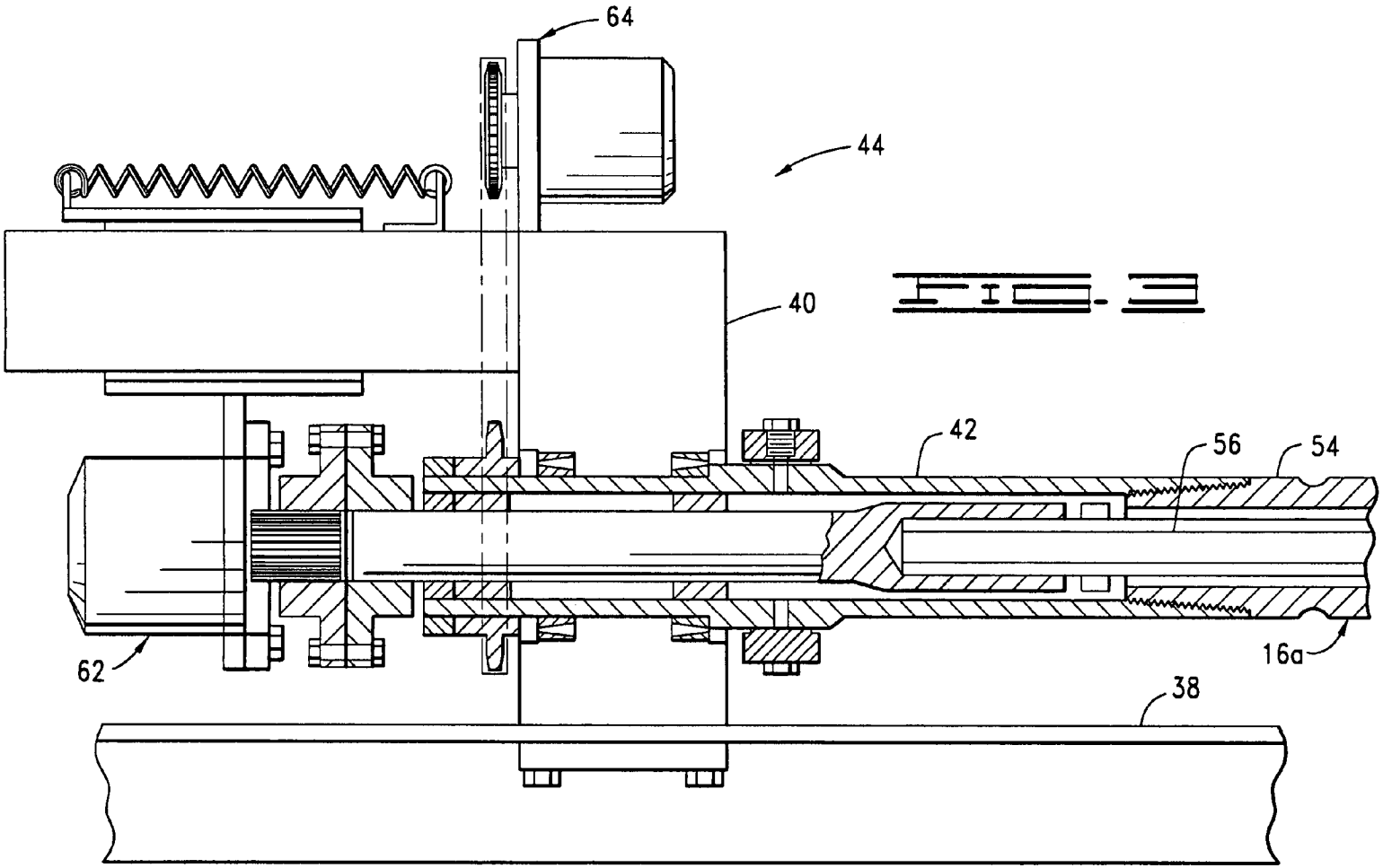
FIG. 3 is a fragmented, side elevational, partly sectional view of a rotary drive useable with the dual-member drill string.

Turning now to FIG. 3, a dual rotary drive system 44 is shown for use as the rotary drive system 20 (FIG. 1). The rotary drive system 44 has dual-spindles 42 for driving a dual-member drill string 16*a*. Rotary drive system 44 is slidably mounted on the frame 38 of drilling machine 22 (FIG. 1) by way of the carriage 40. The rotary drive system 44 comprises two independent drive groups 62 and 64 for independently driving the respective interconnected outer members 54 and interconnected inner members 56 comprising the dual-member drill string 16*a*. The outer members 54 and inner members 54 are thereby independently controllable of each other. For instance, as is advantageous with the present invention, outer members 54 can be held without rotation while inner members 56 are rotated. A suitable dual-spindle rotary drive system 44 is disclosed in U.S. Pat. No. 5,682,956, which is incorporated herein by reference. As subsequently described, inner member drive group 62, also called the inner member drive shaft group, may be adapted to rotationally drive directional boring tool 18.

With reference now to FIG. 4, shown therein is the downhole tool assembly 48 used with a dual-member drill string 16*a* to create borehole 12. Downhole tool assembly 48 comprises the two on-board transmitters or beacons 26 and 28. Data or information transmitted by the beacons 26 and 28 is received and processed, in a manner yet to be described, by receiver 30. Information processed by the receiver 30 may be relayed by wireless communications link 65 to the drilling machine 22, for determining, for example, if a steering correction is required. Alternately, use of the processed information may be accomplished within tracking receiver 30 and control signals 33 communicated to the drilling machine 22.

Figure 5:
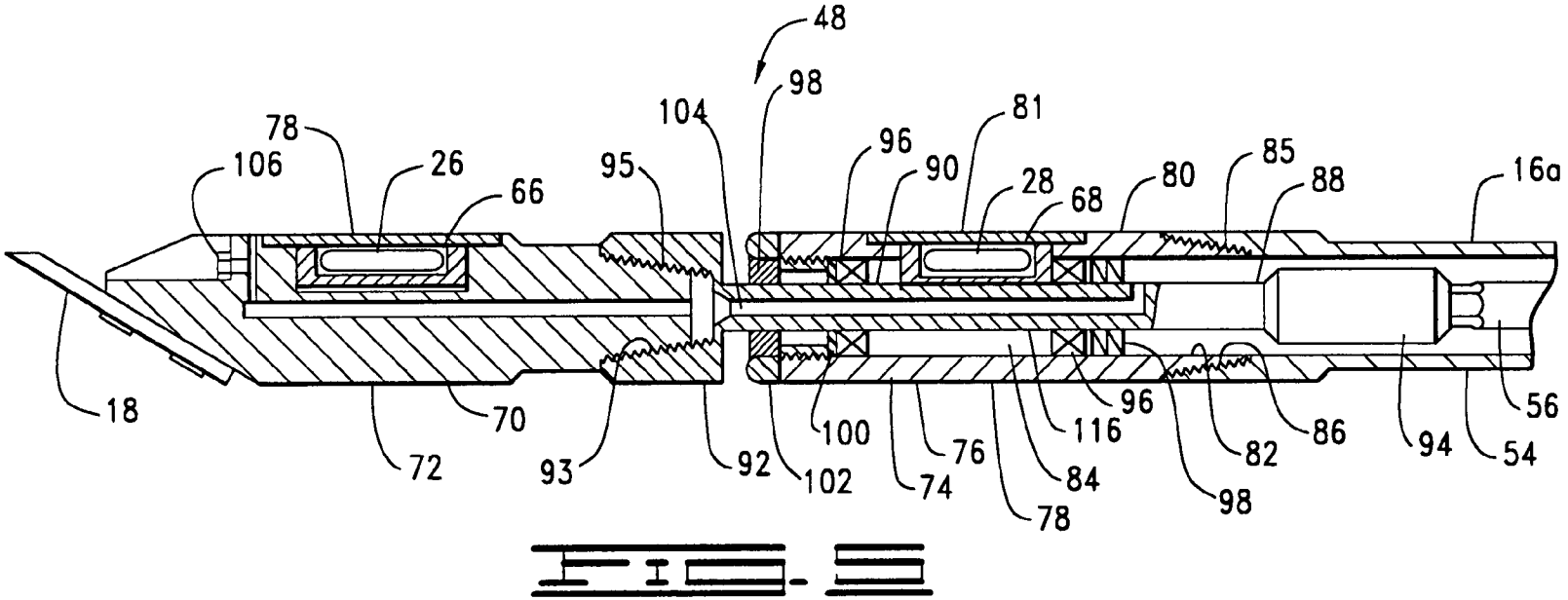
FIG. 5 is a sectional view of the downhole drilling assembly of FIG. 4.

FIG. 5 shows the downhole tool assembly 48 of FIG. 4 in cross-sectional detail. For illustration proposes, side-entry chambers 66 and 68 shown at the 9 o'clock roll angle orientation in FIG. 4 have been moved to the 12 o'clock orientation in FIG. 5. In reference the downhole tool assembly 48 has a forward portion 70 comprising a forward housing assembly 72 and a rear portion 74 comprising a bearing housing assembly 76. The forward housing assembly 72 is preferably fixedly attached to the drill string 16*a*. The round cross-section "forward" and "rearward" portions of downhole tool assembly 48—excluding the slant-faced drill bit—may have a substantially uniform diameter, as so depicted. It should be understood, however, that equality of diameter between the forward and rearward portions of tool 48 is not required.

The directional boring tool 18 is represented herein by the flat-faced bit and a fluid dispensing nozzle. However, as previously mentioned, directional boring tool 18 may be any drilling device or bit which causes deviation of the tool from a straight path when thrust forward without rotation, or if thrust forward while repetitively rocking the drilling bit or boring tool through an arc of partial rotation. The bit, mounted at an approximated 10-degree angle on the downhole end of forward housing assembly 72, is rotationally fixed to the inner member 56 of the drill string 16*a* by way of inner drive member 116 (indicated in FIG. 4 by its front portion). Thus the rotation of these components is through the control of inner member drive group 62.

Forward housing assembly 72 comprises the side-entry chamber 66 to accept the front transmitter or beacon 26, held therein by slotted retaining cover 78. It should be noted that housing assembly 72 could be configured for front-loading or end-loading of the front beacon 26. Preferably, the front beacon 26 is held in rotationally indexed relation to the orientation of directional boring tool 18 such that a roll sensor (not shown) disposed in the front beacon may correctly indicate the rotational orientation of directional boring tool 18. It will be appreciated that the front beacon 26 may contain other sensors as deemed appropriate.

One can appreciate that other methods may also be utilized to indicate the roll position of the directional boring tool 18. For example, a relative rotational position indicator (not shown) within the bearing housing assembly 76 could indicate the roll orientation of forward housing 72 and directional boring tool 18 relative to the absolute rotational position of the bearing housing. The relative rotational position indicator could transfer information to the beacon 28 for communication to receiver 30. Thus, the forward beacon 26 would not be required for this purpose, requiring fewer electronics in the forward beacon and allowing length reduction of the forward housing assembly 72. The resultant reduction in length and surface area of the assembly 72 can be advantageous in high friction soil conditions where the torque transmitting capability of inner member 56 of drill string 16*a* may be limiting.

With continued reference to FIGS. 4 & 5, the bearing housing assembly 76 comprises the inner drive member 116 bearingly supported within a housing 80. The housing 80 comprises the side entry chamber 68. The rear beacon 28 is positioned in the chamber 68 and held therein by a slotted retaining cover 81. The housing 80 further comprises an outer wall 82 that defines an interior bearing chamber 84. A rear end of the housing 80 is connectable to the outer member 54 of the drill string 16*a*. Preferably, the housing 80 has male threading 85 for connection to a threaded female receiving connection 86 on the outer member 54 of the drill string 16*a*. However, it should be understood that other torque transferring connections and configurations for the connections between the housing 80 and the drill string 16*a* are contemplated.

The bearingly supported inner drive member 116 has a rear portion 88, a body 90, and a front portion 92. The front portion 92 is operatively connectable to the previously described forward housing assembly 72. In the preferred embodiment, the front portion 92 comprises a female threaded connection 93 for connection to a corresponding male threading 95 on the forward housing 72. The rear portion 88 extends out from the housing 80 and is connectable to the inner member 56 at the downhole end of the drill string 16*a* such that torque of the inner member is transferred to the inner drive member 116. Preferably, the rear portion 88 of drive member 116 comprises a geometrically shaped female connection 94 for sliding connection to a similarly shaped male connection on the inner member 56 of the drill string 16*a*. Other torque transferring connections and configurations for the connections between the inner drive member 116 and the drill string 16*a* are also contemplated.

The body 90 of the inner drive member 116 is supported within the bearing chamber 84 of the housing 80 by a bearing arrangement 96. Preferably, the bearings 96 are sealed and position the inner drive member 116 generally coaxially within the housing 80. However, some lateral offset or non-symmetrical outer diameter for housing 80 is permissible to accommodate beacon 28 therein. In the preferred embodiment, seals 98, wear rings 100, and seal gland 102 are positioned to retain the bearings 96 in position around the body 90. Preferably, the sealed bearings 96 are periodically lubricated via a pluggable point of access (not shown). This arrangement prevents slurried drill cuttings from reaching and damaging the bearings 96.

One skilled in the art will appreciate the use of drilling fluids during horizontal directional drilling for purposes such as cooling the directional boring tool 18 and the beacons 26 and 28, and to stabilize the borehole. Preferably, the inner drive member 116 comprises at least one fluid passage 104 for communicating drilling fluid from the annular space 58 (shown in FIG. 2) between the inner member 56 and the outer member 54 of the drill string 16*a* through the downhole tool assembly 48 for discharge through a nozzle 106 at a front end of the forward housing assembly 72. The fluid passage 104 preferably passes in proximity to beacons 26 and 28 prior to reaching nozzle 106.

With reference to FIGS. 4 and 5, directional boring tool 18 and forward housing assembly 72 are rotatable by the inner member 56 of the dual-member drill string 16*a* independently of the bearing housing assembly 76, the latter being held without rotation or being separately rotatable by the outer member 54 of the dual-member drill string. As the inner member 56 of the drill string 16*a* is rotated, the change in rotational orientation of the boring tool 18 can be detected by the roll sensor of front beacon 26. This information may be transmitted to the above-ground tracking receiver 30, where it can be further processed, displayed to the receiver operator, and relayed by wireless communications link 65 or other means to the operator and/or automated control system of the drilling machine 22.

Figure 6:
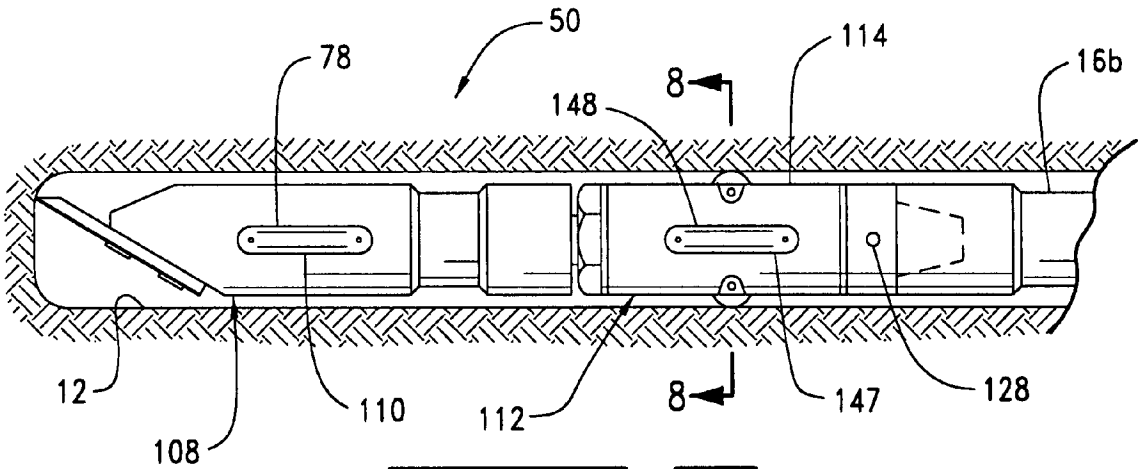
FIG. 6 is a side view of the downhole drilling assembly. The downhole drilling assembly of FIG. 6 is used with a single-member drill string.
Figure 7:
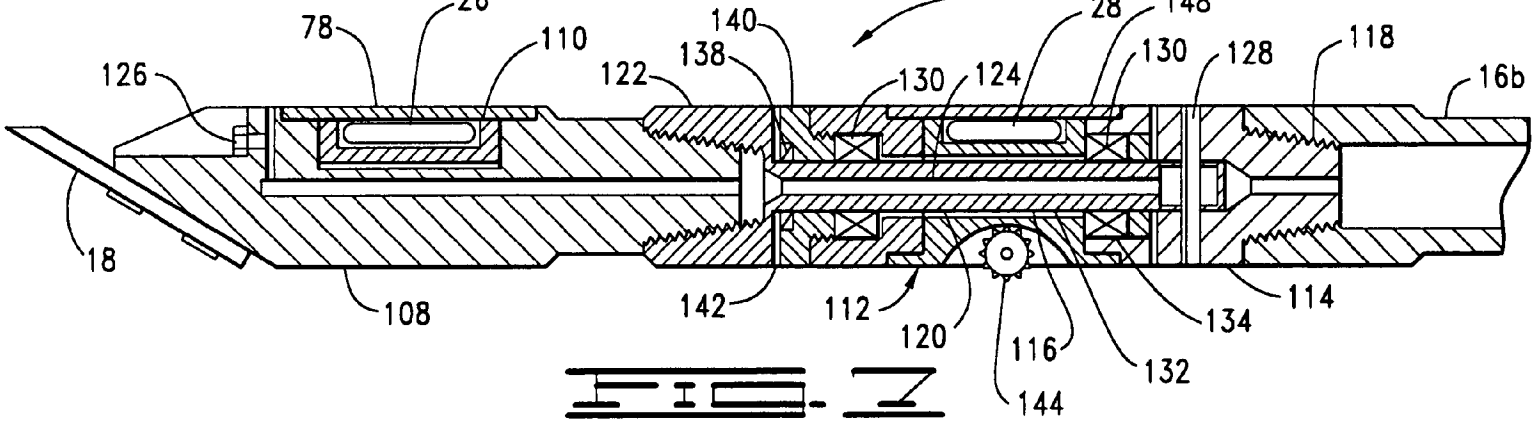
FIG. 7 is a sectional view of the downhole drilling assembly of FIG. 6.

With reference now to FIGS. 6 and 7, shown therein is a downhole tool assembly 50 for use with a single-member drill string 16*b*. The downhole tool assembly 50 comprises a forward housing assembly 108 and is substantially identical to that of the assembly 72 in the previously described embodiment of FIGS. 4 and 5. Similarly as in that embodiment, a side-entry chamber 110—shown in 9 o'clock roll angle orientation in FIG. 6—has been moved to the 12 o'clock orientation in FIG. 7. The downhole tool assembly 50 further comprises a bearing housing assembly 112 at a rear portion of the tool assembly. The bearing housing assembly 112 is adapted for attachment to the downhole end of the single-member drill string 16*b*.

The bearing housing assembly 112, shown in greater detail in FIG. 7, comprises a bearing housing 114 with a straight central axis and an inner drive member 116. The inner drive member 116 is bearingly supported and passes through bearing housing 114.

The inner drive member 116 has a rear portion 118, a body 120, and a front portion 122. Preferably, the inner drive member 116 comprises at least one fluid passage 124 for communicating drilling fluid from the interior of single-member drill string 16*b* through the downhole tool assembly 50 for discharge through a nozzle 126 at a front end of the forward housing assembly 108. The front portion 122 of the inner drive member 116 is operatively connectable to the forward housing assembly 108. Although other forms of construction are contemplated, in the preferred embodiment the front portion 122 comprises a female threaded connection. The inner drive member 116 is connectable to the downhole end of the single-member drill string 16*b*.

As shown in FIG. 7, the bearing housing assembly 112 is held in axial assembly by roll pin 128 engaging the body portion 120 of inner drive member 116 to the rear portion 118. Mating splines (not shown) are contemplated for torque transferal between the body portion 120 of inner drive member 116 and rear portion 118 of the inner drive member 116.

Continuing with reference to FIGS. 6 and 7, the inner drive member 116 of bearing housing assembly 112 is supported within the bearing housing 114 by bearings 130. The rear portion 118 of inner drive member 116 extends out from the housing 114 and is connectable in threaded engagement to the downhole end of drill string 16*b* for torque and thrust transferal. Although threaded engagement is preferred, other torque transferring connections and configurations for the connections between the various components are contemplated. Thus, whenever the single-member drill string 16*b* is rotated, the interconnecting inner drive member 116 rotates the forward housing assembly 108 and the directional boring tool 18. The inner drive member 116 is bearingly supported to prevent corresponding rotation of housing 114.

Bearing housing 114 defines an outer wall 132 and an interior bearing chamber 134. The body 120 of the inner drive member 116 is supported within the bearing chamber 134 by bearing arrangement 130. Preferably, bearings 130 are sealed and position the inner drive member 116 generally coaxially within the housing 114. However, some lateral offset or non-symmetrical outer diameter for housing 114 is permissible to accommodate the beacon 28 therein. In the preferred embodiment, seals 138, wear rings (not shown), seal glands 140, and thrust washers 142 are positioned to retain the bearings 130 in position within housing 114 and around the body 120 of inner drive member 116. Preferably, the sealed bearings 136 are periodically lubricated via a pluggable point of access (not shown). This arrangement prevents slurried drill cuttings from reaching and damaging the bearings 136.

Figure 8:
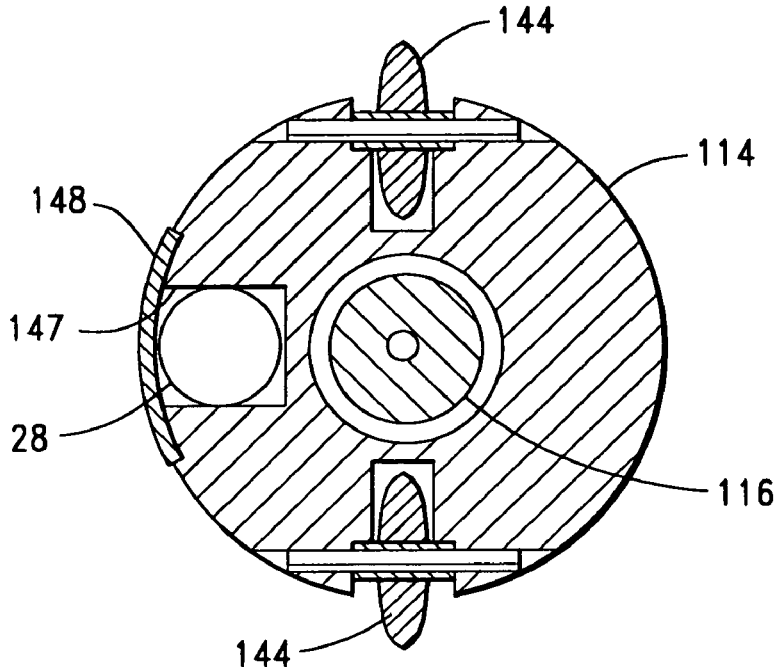
FIG. 8 is a cross-sectional view of the rear housing of the downhole drilling assembly of FIG. 7.
Figure 9:
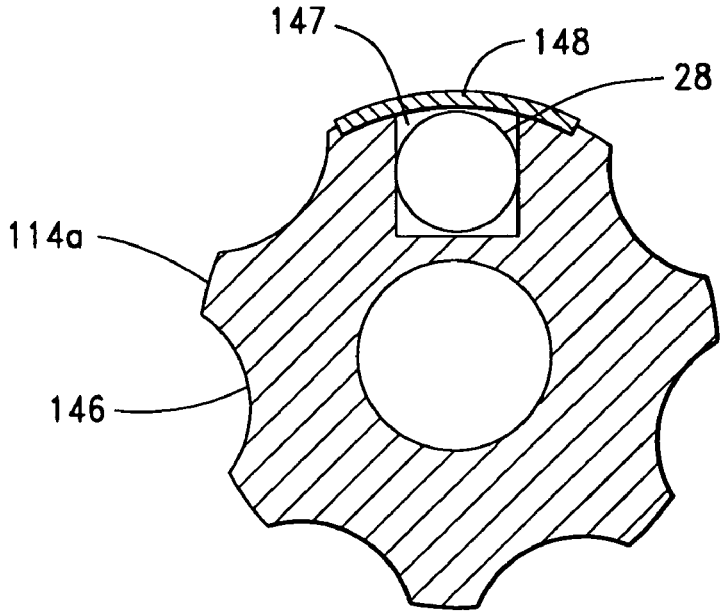
FIG. 9 is a cross-sectional view of an alternative rear housing for the downhole drilling assembly of FIG. 7.

Bearing housing 114 may further comprise an exterior structure for engagement with the wall of the borehole 12 to prevent rotation of the housing 114. Frictional contact forces, spring-loaded fins, or a variety of other techniques may be utilized for this purpose. For instance, bearing-mounted rolling cutter stabilizers 144, shown in FIG. 8, built into housing 114 may serve this purpose. Alternatively, there is shown in FIG. 9 a cross-sectional view of an alternative bearing housing 114*a* wherein the outside diameter is constructed to be an interference fit in the borehole 12. Exterior scallops 146 reduce the effort required to thrust the stabilized housing 114*a* along borehole 12. The scalloped minor outside diameter of housing 114*a* may be sufficiently undersized of the borehole 12 to allow slurried drill cuttings to flow past the housing.

Returning to FIGS. 6 and 7, bearing housing 114 comprises a side-entry chamber 147 to the accept rear transmitter or beacon 28, held therein by a slotted retaining cover 148. As with the embodiment shown in FIGS. 4 and 5, certain sensors within the beacon 28 may have a preferential roll angle alignment, or it may be desirable to hold the sensors in a substantially constant roll angle alignment for improved accuracy of measurement. One skilled in the art will appreciate the need for the ability to index the bearing housing 114 properly after entry into the borehole 12. This may be accomplished by including a dog clutch (not shown) or similar push-pull locking device within housing assembly 112—as described in U.S. Pat. No. 5,490,569 issued to Brotherton, et. al., the contents of which are incorporated herein by reference. Such a device, engaged by retracting the drill string 16*b*, temporarily rotationally locks inner drive member 116 to the bearing housing 114 wherein rear beacon 28 can be indexed to its preferred roll angle alignment. Disengagement is then accomplished by thrusting drill string 16*b* forward without rotation. Other clutching devices may also be suitable for this purpose, such as those engaged by reverse rotation of drill string 16*b*, an increase in drilling fluid pressure, or diversion of drilling fluid flow.

With reference to the embodiments of FIGS. 6–9, to drill a straight segment of borehole 12, the directional boring tool 18 is advanced while rotated by the single-member drill string 16*b*. To change direction, the directional boring tool 18 is oriented in the desired direction by aid of the roll sensor in front beacon 26, then advanced without rotation of drill string 16*b*. In either case, bearing housing 114 is advanced without rotation because of its interfering contact with the borehole 12. By virtue of its contact with the wall of the borehole 12, the bearing housing 114 serves as a stabilizer for the forward portion of downhole tool assembly 50, enhancing its ability to drill a close-tolerance horizontal segment of the borehole 12.

The position and orientation sensing system comprised of beacons 26 and 28 and walkover receiver 30 (FIG. 1) will now be described in greater detail. From the embodiment descriptions herein, it should be apparent that whenever the directional boring tool 18 is rotated to drill a straight segment of the borehole 12, the front beacon 26 and sensors therein for measuring one or more of the angular orientations of forward housing assemblies 72 and 108 also rotate. Rotation can detrimentally affect pitch sensor readings, which are critical for on-grade applications. Also, yaw orientational outputs are generally unavailable at drilling rotational speeds. Placement of such sensors in a non-rotating rear beacon 28 of the present invention overcomes the need for the rotational advance of directional boring tool 18 to be stopped frequently to verify that it has not been deviated up-down and/or left-right off a straight path line by such effects as gravity, the tendency of a rotating bit to "walk", or variations in soil conditions. The monitoring of pitch and, if so desired, yaw headings throughout the creation of the borehole 12 offers substantial productivity improvement. Constancy of the pitch and yaw angular heading components gives assurance that a straight path is being maintained, within the constraints of sensor measurement system accuracy.

For the embodiments of FIGS. 4–9, as indicated previously, beacons 26 and 28 may comprise one or more sensors for measuring information representative of one or more of three angular orientations: roll, pitch and yaw of the respective forward and rearward portions of downhole tool assemblies 48 or 50. Specifically, the front beacon 26 may sense at least the roll orientation angle of directional boring tool 18. The rear beacon 28 can sense at least the pitch orientation angle of the rearward portion of the downhole tool assemblies 48 or 50 and, as may be desired, also its yaw orientation. It should be understood, however, that this does not preclude inclusion of a roll sensor in rear beacon 28—as may be required to properly orient some types of yaw sensors. Additional sensors may also be included within beacons 26 and 28. Sensors for orientation determination may comprise a variety of devices, including: inclinometers, accelerometers, and gyroscopes. This information is attached onto the respective signals transmitted by the beacons 26 and 28 to the above-ground tracking receiver 30 by means of various known communication schemes. Beacons 26 and 28 and the tracking receiver 30 preferably constitute an improved, yet to be described position and orientation sensing system. However, a basic walkover style position and orientation sensing system could also be utilized. Such systems are described in U.S. Pat. No. 5,264,795 issued to Rider, U.S. Pat. No. 5,850,624 issued to Gard, et. al., and U.S. Pat. No. 5,880,680 issued to Wisehart, et. al., the contents of which are incorporated herein by reference. Orientation sensors for determining the roll (a.k.a. tool face), pitch (a.k.a. inclination and grade), and/or yaw (a.k.a. left-right heading and azimuth) angular coordinates comprising the vector heading of the drill head are described in the latter two patents as well as in U.S. Pat. Nos. 5,133,417 and 5,174,033 issued to Rider and U.S. Pat. No. 5,703,484 issued to Bieberdorf, et. al., the contents of which are also incorporated herein by reference.

As used herein, it should be understood that the sensors of beacons 26 and 28 provide the above-mentioned angular information with sufficient accuracy for drilling close-tolerance boreholes. As with front beacon 26 and its housing 72 or 108, the rear beacon 28 is held in rotationally indexed relation to the orientation of housing 80 or 114 to insure there is no shift in rotational relationship during drilling. Preferably, beacons 26 and 28 and their internal sensors are maintained in parallel axial alignment with respect to the central axis of downhole tool assemblies 48 or 50. Not withstanding that preference, one skilled in the art can appreciate that residual non-parallelism can be removed through system calibration and electronic compensation after placement in their respective chambers. It can also be appreciated that, although not so depicted in FIGS. 4–9, some radial protrusion of chambers 66, 68 and 110 and slotted covers 78, 81 and 148 will not detrimentally detract from the performance of downhole tool assemblies 48 or 50.

One skilled in the art will appreciate that other types of position and orientation sensing systems—such as "remote" (non walkover) systems—would also be suitable for use with one or more drilling systems described herein. Alternately, a wireline or other drill string communication system could carry certain information from beacons 26 and 28 back to the drilling machine 22 instead of the wireless communications link 65 illustrated in FIGS. 1 and 4.

The frequency transmissions of beacons 26 and 28 will now be considered. The signal transmissions of conventional beacons are generally at a fixed frequency of either 29 kHz or 33 kHz. Two HDD systems 10 can successfully drill adjacently if their respective beacons 26 and 28 transmit and their respective walkover tracking receivers 30 are set up to receive one or the other of these distinct frequencies. In the present invention, the requirements are that the chosen frequencies be within the range of beacon frequencies suitable for HDD applications, and that their transmissions be sufficiently distinct. Frequency separation and/or improved filtering are techniques for minimizing cross-talk. Beacons 26 and 28 may be positioned in close proximity (less than 10 feet of separation) and transmit to one tracking receiver 30. In this arrangement, two frequencies within an approximate 8 kHz to 40 kHz range may be suitably distinct to prevent undo cross-talk between respective spatially separated transmitting antennas when their frequency separation is on the order of 4 kHz to 10 kHz. For example, the frequencies of 25 kHz and 29 kHz are suitably distinct without improved filtering. Although not required, the lower of the two frequencies may be assigned to forward beacon 26.

When a 25 kHz signal is transmitted by front beacon 26 and a 29 kHz signal is emitted by rear beacon 28, both signals may be processed by tracking receiver 30 to determine the position of downhole tool assembly 48 or 50. Sensor information conveyed on these respective signals may also be decoded by tracking receiver 30 to obtain the respective angular orientations of directional boring tool 18 (being the same as forward housing assembly 72 or 108) and housing 80 or 114.

Whenever progress of directional boring tool 18 is paused, for instance when another pipe section 52 must be added to extend drill string 16, the location (x,z) and depth (y) of one or both beacons 26 and 28 can readily be ascertained in a known manner by use of a conventional walkover receiver having selectable frequency reception, or preferably by tracking receiver 30. The employment of tracking receiver 30 allows both position and orientation information to be obtained whether or not drilling is underway. It is advantageous that this information can be determined in a measurement-while-drilling (MWD) manner throughout the progress of creating the borehole 12; e.g., between any necessary pauses to add pipe to drill string 16. It will be appreciated, however, that a continuous drill string may be used instead of a segmented drill string.

As stated earlier, rear beacon 28 of the present invention is held without rotation by outer drill string member 54 or, for the single-member drill string embodiments, by the stabilizing features 144 or 146 of housing 114 or 114*a*. This offers substantial productivity improvement by allowing pitch—and, when the sensor is included, yaw—headings to be monitored throughout the creation of the borehole 12. This is particularly advantageous while drilling a straight path segment of the borehole 12 wherein to maintain the present heading, forward housing assembly 72 or 108 is rotated while carriage 40 is advanced. Thus any heading sensors within front beacon 26 are subjected to the previously described effects of rotation, whereas those in rear beacon 28 are not. Tracking receiver 30 may now utilize the signal transmissions of rear beacon 28 to process, display, and relay heading and/or positional information for MWD determination whether or not a straight path is being maintained. This enables "on the fly" decision-making control of the HDD system 10 by its operator or by its automated control system.

If a pitch sensor is included within front beacon 26, tracking receiver 30 may receive the pitch of the forward housing assembly 72 or 108 as well as the pitch of bearing housing assembly 76 or 112. The comparison of these spatially separated pitch readings may be possible whenever the directional boring tool 18 is being advanced without rotation to correct or change the directional slope (pitch) of the borehole 12. This is particularly advantageous for close-tolerance on-grade installations.

When directional boring tool 18 such as a flat blade bit is thrust forward without rotation, the soil applies a force component perpendicular to the central axis of downhole tool assembly 48 or 50 that highly influences the resulting directional change. This perpendicular force component generates a curvature within downhole tool assembly 48 or 50 and, generally, also within a short adjacent portion of drill string 16 extending uphole. Thus a change in this "steering force" component can be ascertained by monitored comparison of pitch sensor data transmissions from spatially separated beacons 26 and 28. Also, once advance without rotation is initiated, the onset of a dynamic differential between the two pitch readings gives early indication that an up-down directional change is being effected.

Figure 10:
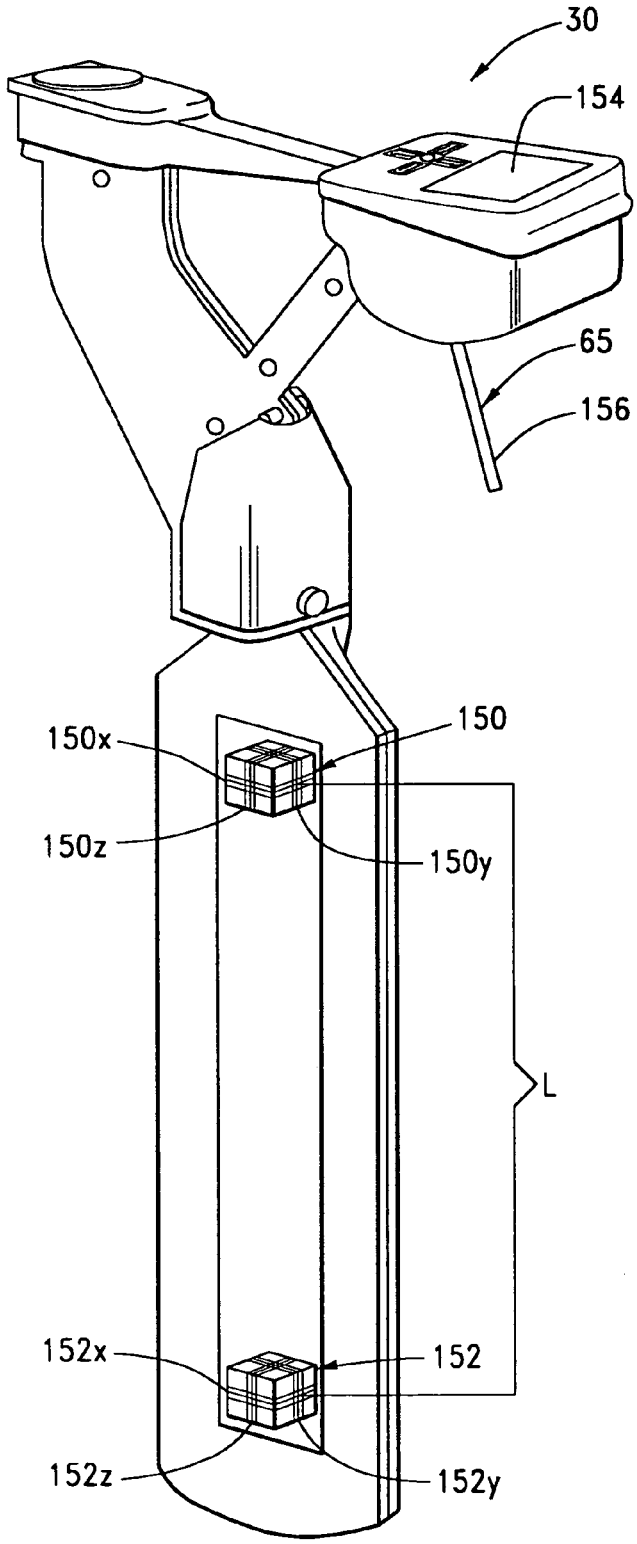
FIG. 10 is a perspective, partially cut-away view of a walkover tracking receiver constructed in accordance with the present invention.

Turning now to FIG. 10, shown therein is a tracking receiver 30 having the ability to monitor the position and orientation of the beacons 26 and 28 within the operating area of the HDD system 10. Positional information (i.e., location and depth) along with pitch heading (and yaw, if desired) is manually or automatically compared to the desired path for the borehole 12, thereby determining any need of directional change in the next interval to be drilled. In general, receiver 30 may be comprised of a plurality of magnetic field sensors 150 an 152, appropriate electronics (not shown) for the amplification and filtering for the outputs of each magnetic field sensor, a multiplexer (not shown), an A/D converter (not shown), processor (not shown), a display 154, wireless communications link 65, batteries (not shown), software/firmware, and other items necessary for system operation, as well as useful accessories (not shown) such as a geographical positioning system.

The throughput of the multiplexer and A/D converter may be designed sufficiently high that the digital representations of the magnetic field vector components sensed by the plurality of magnetic field sensors 150 and 152 are satisfactorily equivalent to being measured at the same instant of time.

The processor within tracking receiver 30 may utilize the magnetic field information and reference positional data (to include the present location of tracking receiver; i.e., the previously described reference placement stations 34) to produce a composite list of information indicative of the relative positions of the beacons with respect to the receiver and the desired path of the borehole 12. This information can be transferred to the display 154 (better seen in FIG. 11) of receiver 30 and communicated by antenna 156 to the drilling machine 22 for control of the HDD system 10.

The placement of receiver 30 must be within an area where reception of the magnetic fields emanating from beacons 26 and 28 are sufficiently distinct for detection, amplification, filtering and processing into positional information having the desired level of accuracy. Further, for ease of handling boundary conditions and positive-negative sign conventions within the software algorithms, it may be advantageous to position receiver 30 forward of the progressing downhole tool assembly 48 or 50 and always in a given approximate orientation thereto. For instance, as illustrated in FIG. 1, it may be advantageous to face receiver 30 toward the approaching downhole tool assembly and align it approximately parallel to the desired path of the borehole 12 when placed on the ground surface at one or more reference placement stations 34*a* through 34*n* established along that desired path. It may be further advantageous that these reference stations be laterally offset from the desired path approximately 5–10 feet, for improved resolution of the magnetic field components emanating from the two beacons. Whenever the advancing downhole tool assembly reaches its locale, the receiver 30 may be repositioned at the next adjacent reference station. The station spacing may be limited by the above-mentioned reception range, thus the intended depth of the borehole 12 can be a factor in their spacing. One can appreciate that other relational alignments may be advantageous toward simplification of the software algorithms and/or hardware of tracking receiver 30.

Before continuing the description of tracking receiver 30, it will be useful to define one or more coordinate systems and reference points or planes. As used herein, the coordinate "z" may represent horizontal distance along the general heading of the borehole 12, the coordinate "x" may represent the left-right horizontal position relative to a particular reference line, and the coordinate "y" may be the depth below ground surface or the vertical offset from a horizontal reference plane. A temporary or local benchmark may serve as the base reference point. A useful temporary benchmark may be the ground entry point of directional boring tool 18, which may be considered as the global origin (x=0, y=0, z=0). It may also be useful to pre-establish secondary origins nearby and along the intended course for the borehole 12 coinciding with the reference stations 34*a* through 34*n* (FIG. 1).

With continuing reference to FIG. 10, the plurality of magnetic field sensors 150 and 152 detect the vector components Hx, Hy and Hz of the composite of the respective magnetic fields and other signals emanating from the beacons 26 and 28. The magnetic field sensors preferably form two antenna arrays 150 and 152 separated by a known distance L. For purposes of illustration, antenna arrays 150 and 152 are shown in a top and bottom arrangement. Antenna arrays 150 and 152 comprise three antennas 150*x*, 150*y*, 150*z*, and 152*x*, 152*y*, and 152*z*, respectively, oriented such that each antenna of each array is mutually orthogonal to the other two. Arranging the antennas in this manner allows the tracking receiver 30 to measure the composite magnetic field components emanating at distinct frequencies from the beacons 26 and 28 in three planes. The measured magnetic field components are separated by the processor into the distinct vector components of each beacon frequency through the utilization of DSP filters and detectors (not shown). Such an arrangement allows determination of the respective beacon positions and also reception of their orientational sensor information without receiver 30 being directly overhead.

Since there are two antenna arrays 150 and 152, there are two sets of magnetic field components resolved at two spatially separated points (separated by the vertical distance L) in the emitted fields of each beacon. Were the placement of tracking receiver 30 always in a known and repeated manner, for instance in the position and orientation described earlier, the two sets of respectively resolved magnetic field vector components emanating from beacons 26 and 28 may be more readily utilized to calculate their respective position and depth in relationship to the two antenna arrays 150 and 152. These relational distances may be translated to coordinates based from the secondary origin at the presently occupied reference station 34*c* (FIG. 1), and thence transformed into global coordinates. The location coordinates of the two beacons define two points in three-dimensional space that may be used to estimate the "average" pitch and yaw of downhole tool assembly 48 or 50. The two sets of magnetic field components may also be used to estimate the respective pitch and yaw of beacons 26 and 28. Sequential comparisons and beacon-to-beacon comparison of these estimates may be useful preliminary indicators of change in the heading of the borehole 12. However for on-grade applications in particular, "field component" pitch estimates are unlikely to yield sufficient accuracy to supplant the need of a pitch sensor in one or more of the beacons.

A vector summation of each set of the resolved magnetic field vector components for each beacon separately determines their respective total fields $Top_F$ and $Bot_F$, and $Top_R$ and $Bot_R$ sensed by antenna array 150 and 152 respectively. ("F" represents front beacon 26, "R" represents rear beacon 28, "Top" represents the upper antenna array 152, and "Bot" represents the lower antenna array 152.) The direction angles from each antenna array 150 and 152 to each beacon 26 and 28 may be determined by ratioing each total field to its resolved magnetic field vector components. The distances between each antenna array and each beacon can be determined from these sets of angles and the known distance L by utilizing the law of cosines. These "straight line" distances may then be converted to the above-mentioned position (X, Z) and depth (Y) components. Non parallel alignment between the actual position of downhole tool assembly 48 or 50 and the placement of tracking receiver 30 may also be determined from the measured magnetic field components, for visualization on the display 154.

It should be clear from the above discussion that, in addition to pitch and azimuthal information, positional and depth of beacons 26 and 28 can be determined while the downhole tool assembly 48 or 50 is being advanced with or without rotation in the creation of borehole 12.

Figure 11:
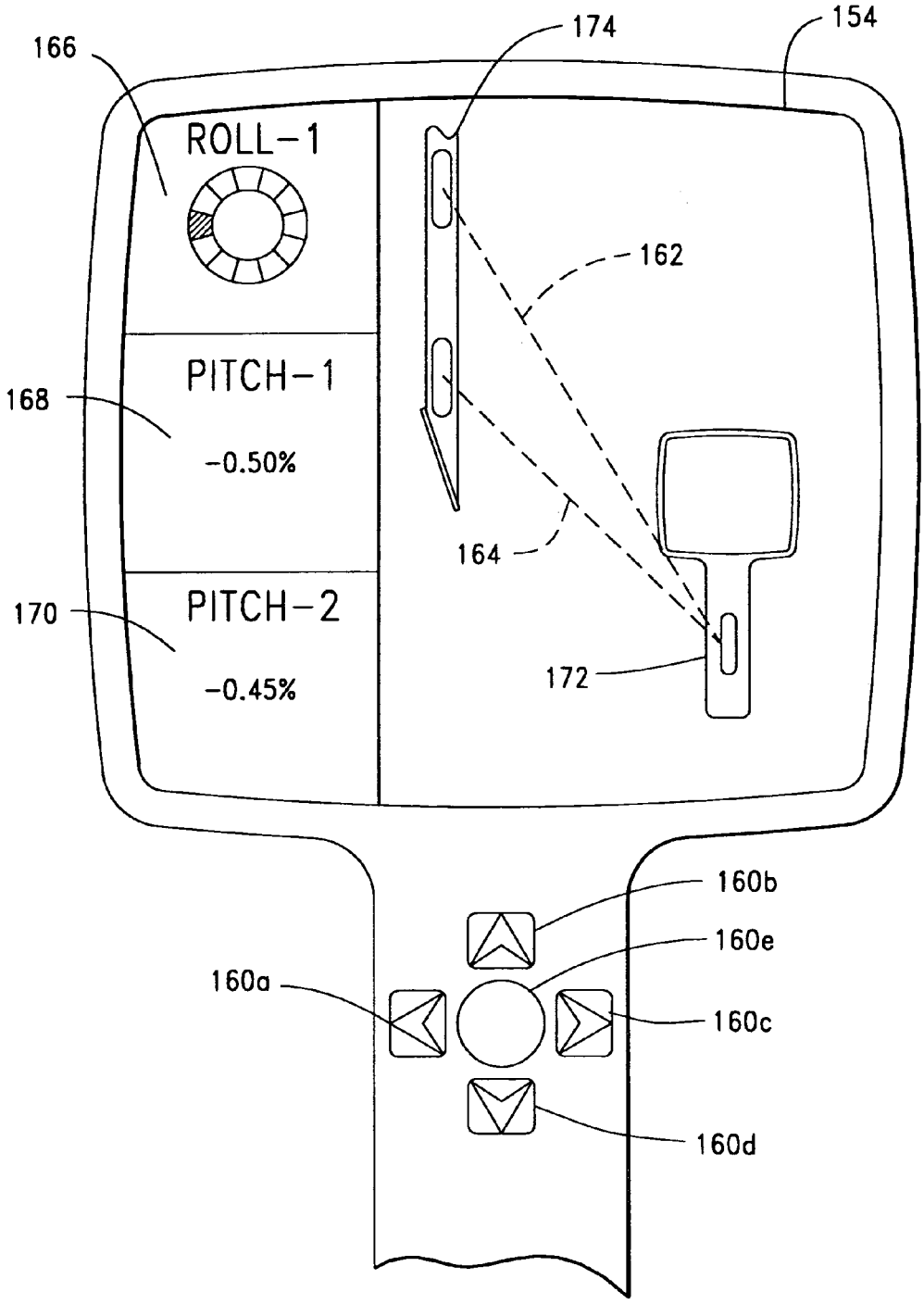
FIG. 11 is a fragmented plan view of the walkover tracking receiver of FIG. 10.

Turning now to FIG. 11, shown therein is the display 154 of tracking receiver 30. The display 154 gives the operator a clear, easy-to-read display of the area through which the downhole tool assembly 48 or 50 and beacons 26 and 28 are moving. The controls comprising five keys 160 are positioned for convenient one-handed operation, and control all the functions of the tracking receiver 30.

The display 154 is capable of providing the tracking receiver operator with a wide array of information related to the horizontal directional drilling operation. Such information may also be relayed to the operator of drilling machine 22 in a manner previously described, whether or not tracking receiver 30 is being monitored by its operator. In other words, the tracking receiver operator need not remain in the vicinity of receiver 30 other than to periodically advance it to the next reference placement station. As shown in FIG. 11, a liquid crystal display ("LCD") may be used to display several operating parameters of the boring operation in addition to the positional relationship of the beacons 26 and 28 with respect to tracking receiver 30. For example, the operator may monitor the roll orientation of the beacon 26, and the pitch and/or azimuthal information of beacon 28. Depth (y), lateral offset (x) and radial distance to one or both beacons can also be displayed with respect to the presently occupied reference station 34*c*, the radial "ray" relationship being indicated by broken lines 162 and 164.

The display 154 may be configured to use either textual characters or icons to display information to the operator. For example, graphical display 166 displays roll orientation of the beacon 26 while textual displays 168 and 170 display the respective pitch of beacon 26 and 28. These segments of display 154 may be shifted—by scrolling to other menu selections accessible via keys 160—to display the positional coordinates of beacon 26 and/or beacon 28 with respect to tracking receiver 30 or to display azimuthal information that may be available from one or more of the beacons. Other information icons (not shown), such as temperature and battery strength of the beacons can be programmed to appear upon operator request or when one or more operating parameters reach a critical range.

Display 154 is adapted to show a composite display of the operating area. The composite shows the relative positions of the beacons 26 and 28, and the tracking receiver 30. The receiver 30 is represented by a receiver icon 172. The beacons 26 and 28 in downhole tool assembly 48 or 50 are represented on the display 154 by a downhole tool assembly icon 174. Numerical displays (not shown) may be used, in conjunction with broken lines 162 and 164, to communicate the horizontal distance, depth, and angle of orientation of the beacons 26 and 28 relative to the tracking receiver 30.

The receiver icon 172 remains in a fixed position on the display 154 during operation of the system while the positional relationship between the downhole tool assembly icon 174 changes with respect thereto to reflect progress of the boring operation. The downhole tool assembly icon 174 also shows azimuthal orientation relative to the receiver icon 172 as azimuth of the downhole tool assembly 48 or 50 changes in relation to the tracking receiver 30. In other words, the "parallel heading" of icon 174 with respect to receiver icon 172 illustrated on display 154 in FIG. 11 can be varied to reflect the actual measured orientational relationship of downhole tool assembly 48 or 50 and tracking receiver 30.

Continuing with FIG. 11, the five keys 160 function to provide a user-friendly interface between the tracking receiver 30 and its operator. The menu key 160*e* brings up the menu screen, and is also used to revive the system after it has entered sleep mode. The left and right arrow keys 160*a* and 160*c* are used to adjust various system operating parameters as needed. The up-arrow key 160*b* and the down-arrow key 160*d* are used to step through selections within functions, and to raise and lower adjustments such as sensor assembly gain. Keys 160 are not limited by this description, and may be programmed for other useful functions and operations.

As stated previously, "remote" (non walkover) systems could be utilized to obtain the above-described positional and orientational information. For instance, sensor information from forward housing assembly 72 or 108 could be communicated by short distance electromagnetic telemetry to housing assembly 76 (or oppositely in the instance of housing assembly 112) wherein resides essentially a conventional remote navigational system (a.k.a. an electronic "steering tool") which relays the information of both forward and rear sensor packages up drill string 16 by one of several known techniques.

Figure 12:
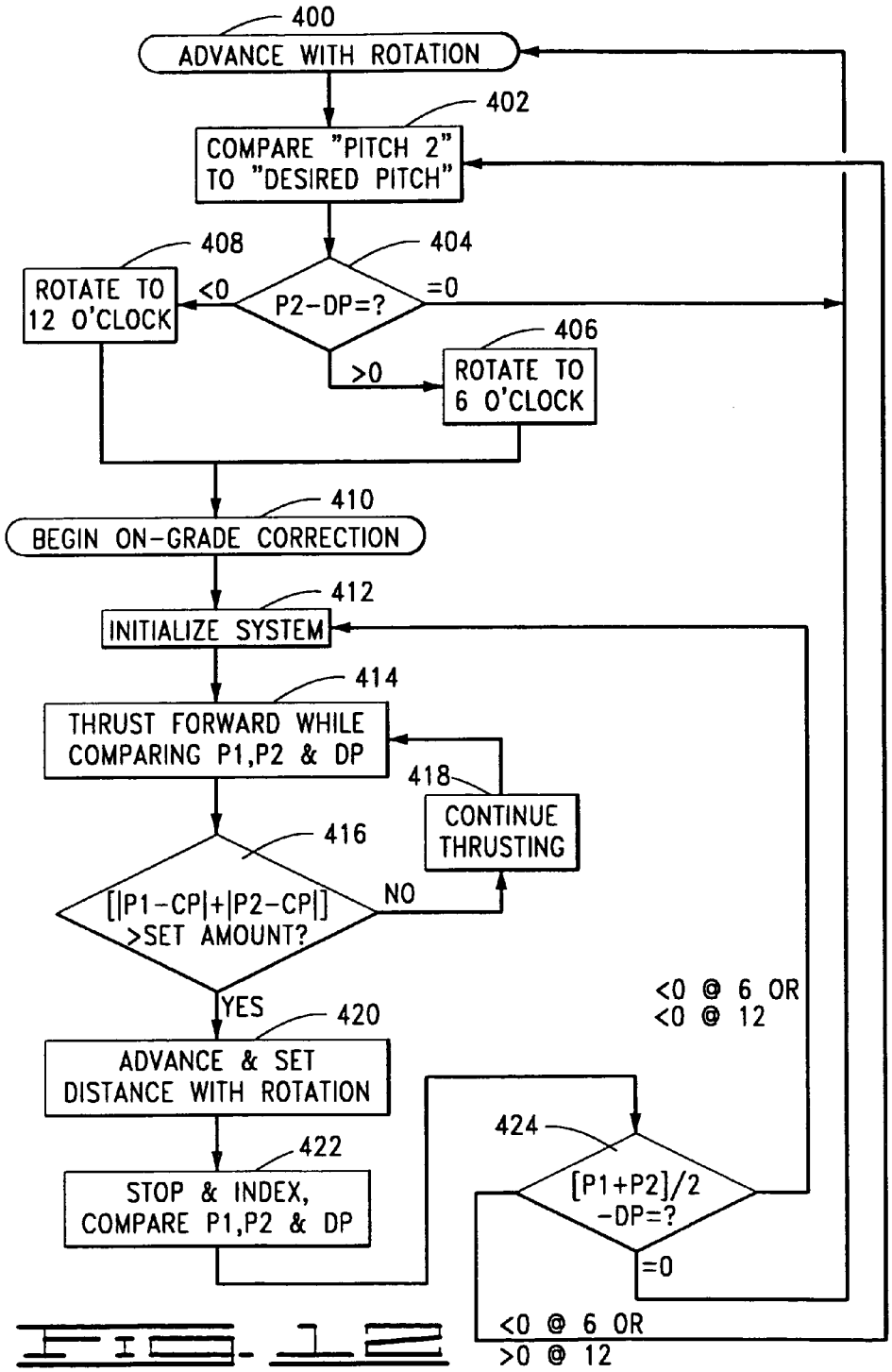
FIG. 12 is a flow chart illustrating the use of two beacons for steering the downhole drilling assembly to create an on-grade borehole.

Turning now to FIG. 12, shown therein is a basic flow chart for employing pitch readings of two spatially separated beacons 26 and 28 toward the aid of making steering decisions. Those skilled in the art of horizontal directional drilling appreciate that a number of different indicators can be utilized to verify whether or not directional boring tool 18 is progressing the borehole 12 along its desired course. Sometimes singular indicators are sufficient, but most often the combination of several are utilized. For instance, determination of the need for an up or down (12 o'clock or 6 o'clock) steering correction could be substantiated by or even solely determined by measuring the depth of front beacon 26, rear beacon 28, or both, with tracking receiver 30 and relating this information to a reference surface elevation for comparison to the desired course. A step-wise pitch calculated from the above depth readings could also be used to infer proper course heading. Appropriate decision logic of this nature could be incorporated at steps 402 and 404 of FIG. 12.

With continuing reference to FIG. 12, the "advance with rotation" operating mode 400 entry point into the flow chart represents a directional boring tool 18 that is drilling the on-grade "horizontal" section of the borehole 12. Boring tool 18 is advanced with rotation to continue progressing on its present heading. However, in the manner previously described, boring tool 18 may begin drifting off course. This is detected in step 402 by comparing the MWD pitch readings of rear beacon 28 (Pitch 2 or P2) to the "Desired Pitch" (DP). This comparison may be either time interval or distance interval based. In step 404, if P2 equals or is within a preselected tolerance of DP, advance with rotation continues at step 400. If P2 is greater than DP (i.e., P2−DP>0) by more than the preselected tolerance, advance with rotation ceases and directional boring tool 18 is oriented to the 6 o'clock position at step 406. In the opposite case, where P2 is less than DP (i.e., P2−DP<0) by more than the preselected tolerance, advance with rotation ceases and directional boring tool 18 is oriented to the 12 o'clock position at step 408. This preselected tolerance and other preselected parameters within the FIG. 12 flow chart may be initially set on the basis of anticipated soil conditions along the desired course of borehole 12. As will soon be described, some or all of these parameters may be incrementally adjusted as the bore progresses, to reflect the recently noted responsiveness of directional boring tool 18.

A correction back on-grade is initiated at step 410. The initialization process at step 412 involves a first comparison of P1, the pitch of front beacon 26, with P2 to adjust for any residual or quasi-static differential. It may also be useful at this time to "normalize" P1 and P2 through their division by DP (or alternately by subtraction of DP from their values). This normalized "Current Pitch" (CP) then becomes the reference pitch from which changes are measured while the boring tool 18 is advanced beyond this point without rotation.

In the feedback loop of steps 414, 416 and 418, directional boring tool 18 is advanced without rotation until the absolute value of P1 minus CP plus the absolute value of P2 minus CP exceeds a preselected value indicative that a potentially sufficient up/down directional change has been initiated. Absolute values are summed at step 416 since the previously mentioned steering-induced curvature to downhole tool assembly 48 or 50 may cause, in the instance of a 12 o'clock (6 o'clock) steering direction, a decrease (increase) in P2 of approximately the same angular amount that P1 increases (decreases) in response to the steering force. In such an instance, direct addition (P1+P2) would incorrectly suggest that a steering correction had yet to be initiated. The preselected "Set Amount" in step 416 must also accommodate sensor and measuring system resolution. If, for example, the pitch sensors of beacons 26 and 28—in combination with the circuitry of the beacons and receiver 30—are capable of resolving a change in grade no smaller than 0.1%, the preselected comparison value (i.e., the initial "Set Amount") in step 416 could not be that small (i.e., 0.1% slope) but more preferably on the order of 0.2% slope. In subsequent passes through this loop, adjustments may be made, at step 412, to the preset parameters of step 414 or to the form of logic and/or its preselected tolerance at step 416.

The sufficiency of the above directional change to bring borehole 12 back onto the desired grade or pitch, DP, is tested beginning at step 420 by advancing a preset distance while the boring tool 18 is being rotated. In average soil conditions this distance is preferably preset at approximately 12 inches. Advance and rotation are stopped at step 422, then rotation is indexed to the prior 6 or 12 o'clock steering direction utilized at step 410. Since some offset may have been introduced through the actions of steps 414 through 422, the average of P1 and P2 are compared to DP at step 424. Alternatively, P1 alone could be compared to DP at this point. If the comparison is favorable, as indicated by a zero or within preselected tolerance differential, borehole 12 is back on the proper grade and advance with rotation continues at step 400. If the necessary correction is yet to be achieved, preset parameters may be incrementally adjusted upon return to step 412.

In the event over-correction has occurred, it must be counteracted by a short segment of steering in the opposite direction. This is indicated in FIG. 12 by returning to step 402. Alternately, since the prior 6 or 12 o'clock steering direction is known, boring tool 18 could be indexed to the opposite orientation and control returned directly to step 410. In either case, appropriate preset parameters would be adjusted to factor in the recently noted steering response of directional boring tool 18 before initiating this short steering segment. In this or other subsequent passes through the overall control loop, adjustments may be made to the preset parameters of steps 402, 414, 420, and 422 or to the form of logic and/or its preselected tolerance at steps 404, 416, and 424.

Other control logic is contemplated for utilizing the pitch of multiple spatially separated beacons. Multiple beacons offer improved manual and/or automatic operation of the HDD system 10, particularly when drilling the close-tolerance on-grade segment of the borehole 12, but for other applications as well.

Though often less critically controlled, directional changes in yaw (left-right) may also be necessary to maintain the desired course. When yaw sensing capability is included in beacons 26 and 28, logic much the same as in FIG. 12 may be utilized to control the left-right progress of directional boring tool 18, wherein their yaw readings (azimuths) would be compared to a Current Azimuth and to a Desired Azimuth.

It is clear that the present invention is well adapted to attain the ends and advantages mentioned as well as those inherent therein. While the presently preferred embodiments of the invention have been described for purposes of this disclosure, it will be understood that numerous changes may be made in the combination and arrangement of the various parts, elements and procedures described herein without departing from the spirit and scope of the invention as defined in the following claims.

What is claimed is:

1. A system for use with a horizontal directional drilling machine to monitor the position and orientation of a downhole tool assembly, the system comprising:

a first beacon supported by the downhole tool assembly having at least one orientation sensor and adapted to transmit signals indicative of the position and orientation of the downhole tool assembly;

a second beacon supported by the downhole tool assembly and spatially separated from the first beacon, wherein the second beacon has at least one orientation sensor and is adapted to transmit signals indicative of the position and orientation of the downhole tool assembly; and a receiving assembly comprising:

an antenna arrangement adapted to detect signals emanating from the first beacon and the second beacon;

a processor supported by the receiving assembly and adapted to receive the detected signals, to process the detected signals, to generate a composite of the relative positions of the receiving assembly, the first beacon, the second beacon, and the downhole tool assembly; and a display adapted to visually communicate the composite of the relative positions of the receiving assembly, the first beacon, the second beacon, and the downhole tool assembly and the orientation of the downhole tool assembly, the first beacon and of the second beacon.

2. The system of claim 1 wherein the signals transmitted by the first beacon and the second beacon each comprise an electromagnetic field adapted to communicate position and orientation information.

3. The system of claim 1 wherein the first beacon orientation sensor comprises a pitch sensor adapted to determine the pitch orientation of the first beacon and wherein the second beacon orientation sensor comprises a pitch sensor adapted to determine the pitch orientation of the second beacon.

4. The system of claim 1 wherein the first beacon orientation sensor comprises a roll sensor adapted to determine the roll orientation of the first beacon and wherein the second beacon orientation sensor comprises a roll sensor adapted to determine the roll orientation of the second beacon.

5. The system of claim 1 wherein the antenna arrangement comprises at least two sets of three mutually orthogonal coils.

6. The system of claim 5 wherein each set of coils is separated a known distance from the other.

7. The system of claim 1 wherein the processor is adapted to determine the distance between the receiving assembly and each of the first beacon and the second beacon from the detected signals.

8. A horizontal directional drilling system comprising:

a frame;

a drill string having a first end and a second end;

a rotary drive system attachable to the frame, operatively connectable to the first end of the drill string, and adapted to rotate and advance the drill string;

a downhole tool assembly comprising:

a bearing housing assembly connectable to the second end of the drill string;

a front housing connectable to the bearing housing assembly and rotatable independently of the bearing housing assembly;

a first beacon supported by the front housing for movement therewith and adapted to transmit signals indicative of the orientation of the front housing;

a second beacon assembly supported by the bearing housing assembly for movement therewith and adapted to transmit signals indicative of the orientation of the bearing housing assembly; and a receiving assembly adapted to monitor the orientation of the bearing housing assembly and the front housing, the receiving assembly comprising:

an antenna assembly adapted to detect the signals emanating from both the first beacon and the second beacon and to transmit the detected signals; and a processor assembly adapted to receive the detected signals from the antenna assembly, to process the detected signals to determine the orientation of the front housing and the orientation of the bearing housing assembly.

9. The horizontal directional drilling system of claim 8 wherein the signals transmitted by the first beacon and the second beacon each comprise an electromagnetic field adapted to transmit position and orientation information.

10. The horizontal directional drilling system of claim 8 wherein the first beacon orientation sensor comprises a pitch sensor adapted to determine the pitch orientation of the first beacon and wherein the second beacon orientation sensor comprises a pitch sensor adapted to determine the pitch orientation of the second beacon.

11. The horizontal directional drilling system of claim 8 wherein the first beacon orientation sensor comprises a roll sensor adapted to determine the roll orientation of the first beacon and wherein the second beacon orientation sensor comprises a roll sensor adapted to determine the roll orientation of the second beacon.

12. The horizontal directional drilling system of claim 8 wherein the antenna arrangement comprises at least two sets of three mutually orthogonal coils.

13. The horizontal directional drilling system of claim 12 wherein each set of coils is separated a known distance from the other.

14. The horizontal directional drilling system of claim 8 wherein the processor is adapted to determine the distance between the receiving assembly and each of the first beacon and the second beacon using the detected signals.

15. The horizontal directional drilling system of claim 8 wherein the front housing further comprises a directional drill bit.

16. The horizontal directional drilling system of claim 15 wherein the drill string comprises an outer member and an inner member, wherein the inner member is disposed within the outer member and movable independently of the outer member.

17. The horizontal directional drilling system of claim 16 wherein operation of the directional drill bit is driven by rotation of the inner member of the drill string.

18. The horizontal directional drilling system of claim 15 wherein the downhole tool assembly further comprises a drive member supported by the bearing housing assembly for movement therein independent of the bearing housing assembly, wherein the drive member is adapted to drive operation of the directional drill bit in response to rotation of the drill string.

19. The horizontal directional drilling system of claim 18 wherein the drill string comprises an outer member and an inner member, wherein the inner member is disposed within the outer member and operatively connected to the drive member so that rotation of the inner member drives operation of the drill bit.

20. The horizontal directional drilling system of claim 8 wherein the bearing housing comprises at least one borehole engaging member adapted to substantially limit rotation of the bearing housing when the front housing is rotated.

21. The horizontal directional drilling system of claim 20 wherein the borehole engaging member comprises a rolling cutter stabilizer.

22. The horizontal directional drilling system of claim 20 wherein the bearing housing comprises an exterior surface and wherein the borehole engaging member comprises a plurality of ribs formed on the exterior surface of the bearing housing to substantially limit rotation of the bearing housing.

23. The horizontal directional drilling system of claim 8 further comprising a control for operating the rotary drive system and wherein the receiving assembly further comprises a transmitter for communicating information to the control.

24. A downhole tool assembly for use with a rotatable drill string comprising:

a rotatable bearing housing assembly connectable to the second end of the rotatable drill string;

a front housing connectable to the bearing housing assembly and rotatable independently of the bearing housing assembly;

a first beacon supported by the front housing for movement therewith and adapted to transmit signals indicative of the orientation of the front housing; and a second beacon assembly supported by the bearing housing assembly for movement therewith and adapted to transmit signals indicative of the orientation of the bearing housing assembly.

25. The downhole tool assembly of claim 24 wherein the signals transmitted by the first beacon and the second beacon each comprise an electromagnetic field.

26. The downhole tool assembly of claim 24 wherein the first beacon orientation sensor comprises a pitch sensor adapted to determine the pitch orientation of the front housing and wherein the second beacon orientation sensor comprises a pitch sensor adapted to determine the pitch orientation of the bearing housing assembly.

27. The downhole tool assembly of claim 24 wherein the first beacon orientation sensor comprises a roll sensor adapted to determine the roll orientation of the front housing and wherein the second beacon orientation sensor comprises a roll sensor adapted to determine the roll orientation of the bearing housing assembly.

28. The downhole tool assembly of claim 24 wherein the downhole tool assembly further comprises a drive member supported by the bearing housing assembly for movement therein independent of the bearing housing assembly.

29. The downhole tool assembly of claim 28 wherein the front housing further comprises a directional drill bit operatively connected to the drive member.

30. The downhole tool assembly of claim 24 wherein the bearing housing assembly comprises at least one borehole engaging member adapted to substantially limit rotation of the bearing housing when the front housing is rotated.

31. The downhole tool assembly of claim 30 wherein the borehole engaging member comprises a rolling cutter stabilizer.

32. The downhole tool assembly of claim 24 wherein the bearing housing assembly further comprises a clutching assembly used to selectively position the rotational orientation of the bearing housing.

33. A method for drilling a borehole having a desired orientation, using a downhole tool assembly and a receiving assembly, the downhole tool assembly comprising a first beacon and a second beacon both supported by the downhole tool assembly, wherein the first beacon is adapted to transmit a first locating signal and wherein the second beacon is adapted to transmit a second locating signal, the method comprising:

sensing the first locating signal emanating from the first beacon and the second locating signal emanating from the second beacon; and processing the sensed first and second locating signals to generate a composite of the relative position of the receiving assembly to the first beacon and the second beacon.

34. The method of claim 33, wherein the first beacon comprises an orientation sensor, the method further comprising sensing the orientation of the first beacon.

35. The method of claim 34, wherein the second beacon comprises an orientation sensor, the method further comprising:

sensing the orientation of the second beacon;

comparing the orientation of the first beacon to the desired orientation of the borehole;

comparing the orientation of the second beacon to the desired orientation of the borehole; and redirecting the downhole tool assembly so that the orientation of both the first and second beacons are substantially similar to the desired orientation of the borehole.

36. A method for drilling a borehole having a desired pitch using a downhole tool assembly attached to a drill string and a signal receiving assembly, the downhole tool assembly comprising a first beacon adapted to emit a first pitch signal indicative of the pitch orientation of the first beacon and a second beacon spatially separated from the first beacon and adapted to emit a second pitch signal indicative of the pitch orientation of the second beacon, the method comprising:

sensing the first pitch signal and the second pitch signal using the signal receiving assembly;

processing the first pitch signal and the second pitch signal substantially simultaneously to determine the pitch orientation of the first beacon and the pitch orientation of the second beacon; and comparing the pitch of the first beacon and the pitch of the second beacon to the desired pitch.

37. The method of claim 36, wherein the downhole tool assembly comprises a directional drill bit, the method further comprising:

axially advancing the directional drill bit; and selectively rotating the directional drill bit using the drill string for a period of axial advance.

38. The method of claim 36, wherein the drill string comprises a plurality of connectable pipe sections, each pipe section having an inner member disposed longitudinally within a hollow outer member, each outer member being connectable to another one of the outer members comprising the plurality of pipe sections and each inner member being connectable to another one of the inner members comprising the plurality of pipe sections, and wherein the plurality of inner members are rotatable independently of the outer members, the method further comprising:

changing the orientation of the first beacon with the interconnected inner members.

39. The method of claim 38 further comprising changing the orientation of the second beacon with the interconnected outer members.

40. The method of claim 38, wherein the downhole tool assembly comprises a directional drill bit, the method further comprising:

axially advancing the directional drill bit; and selectively rotating the directional drill bit using the interconnected inner members of the drill string.

* * * * *